United States Patent [19]

Rehm

[11] Patent Number: 4,938,298

[45] Date of Patent: Jul. 3, 1990

[54] DIRECTIONAL WELL CONTROL

[75] Inventor: William A. Rehm, Houston, Tex.

[73] Assignee: BecField Horizontal Drilling Services Company, Houston, Tex.

[21] Appl. No.: 315,882

[22] Filed: Feb. 24, 1989

[51] Int. Cl.[5] ..... E21B 7/06

[52] U.S. Cl. ..... 175/61

[58] Field of Search ..... 175/61, 73, 75, 45

[56] References Cited

U.S. PATENT DOCUMENTS

| | | | |
|---|---|---|---|
| 4,653,598 | 3/1987 | Schuh et al. | 175/75 |
| 4,667,751 | 5/1987 | Geczy et al. | 175/61 |
| 4,739,842 | 4/1988 | Kruger et al. | 175/61 |
| 4,789,032 | 12/1988 | Rehm et al. | 175/45 |

OTHER PUBLICATIONS

Rehm et al., "Horizontal Drilling in Mature Oil Fields," SPE Paper No. 18709 (1988).

Maurer et al., "Selecting Pad Heights for the First Austin Chalk Drainhole Field Test," May 30, 1985.

Tiraspolsky, Hydraulic Downhole Drilling Motors (1985) pp. 193–194.

Taylor et al., "A Systematic Approach to Well Surveying Calculations," SPE Paper No. 3362 (1971).

Karlsson et al., "Performance Drilling Optimization," SPE Paper No. 13474 (1985).

Hempkins et al., "Multivariate Statistical Analysis in Formation Evaluation," SPE Paper No. 7144 (1978).

Hempkins et al., "Multivariate Statistical Analysis of Stuck Drillpipe Situations," SPE Drill. Eng., 1987, pp. 237–244.

Rehm, "Horizontal Drilling Applied in Slim Holes," Petroleum Engineer Int'l, Feb. 1987.

Ehlers et al., "Case History of Horizontal Wells Drilled With Navigation Technology in European Operations," SPE Paper No. 18654 (1989), pp. 315–324.

Whitten et al., "Unleashing the Power of Steerable Systems," SPE Paper No. 18655 (1989), pp. 325–332.

Karlsson et al., "New Development in Short-, Medium-, and Long-Radius Lateral Drilling," SPE Paper No. 18706 (1989), pp. 725–736.

Jourdan et al., "How to Build and Hold a 90° Angle Hole," SPE Paper No. 18707, (1989), pp. 737–748.

*Primary Examiner*—Hoang C. Dang

*Attorney, Agent, or Firm*—Townsend and Townsend

[57] ABSTRACT

A method and apparatus for prediction of the turn rate of a deviated well is disclosed. The turn rate is determined by collecting data for interference, bend length, and rate of turn from a variety of drilled wells. Using regression technique, turning rate is then expressed as a linear function of the ratio of interference to bend length.

7 Claims, 2 Drawing Sheets

DIRECTIONAL WELL CONTROL

CROSS-REFERENCE TO RELATED APPLICATIONS

The present inventin is related to an application having Serial No. 101,249, now U.S Pat. No. 4,789,032, which is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of the Invention

The present invention is related to the field of well drilling. In particular, the present invention provides a method and apparatus for determining the turning radius of a well drilled with a particular drilling assembly in a hydrocarbon formation.

2. Description of Related Art

Directional wells have been utilized in the petroleum industry for several decades. For example, directional wells have been used on offshore platforms to drill wells into locations that the laterally displaced from the location of the platform.

It has recently become more economical to fully develop known reserves, rather than attempt to locate new reserves. As a consequence, drilling from existing facilities has become increasingly important and hence, the ability to reach laterally-displaced locations has become increasingly important. Wells are frequently drilled today which deviate significantly from vertical (e.g., 45° or more) and in many cases the prospect of drilling horizontal wells has become attractive. U.S. Pat. No. 4,789,032 describes one possible horizontal drilling method and apparatus and is incorporated herein by reference for all purposes.

In highly deviated wells, accurate planning is required to prevent damage to the drill bit, to ensure that the desired location is drilled, to prevent stuck drill pipe, and the like. In particular, it is important to be able to accurately predict the radius of curvature that will be produced by a given drilling assembly before the well is drilled. If the radius of curvature is not accurately predicted it may be necessary to change the bend of the drilling apparatus or to change the bend in the motor after drilling operations have commenced. This can be extremely expensive dure to lost rig time.

Interference has been recognized as an important parameter in predicting the radius of curvature that will be produced by a drilling assembly. As used herein, interference is intended to mean the lateral distance beyond the wellbore wall which an unstressed drilling assembly would extend, especially drill pipe using a bent sub or motor. FIG. 1 illustrates the interference of a bent drill assembly 2 in a wellbore 4.

An estimate of interference has been used to predict the turning radius of a wellbore, to predict the force applied by the bit on the well bore, and the like. Various methods have been proposed to determine interference in a wellbore and, further, to predict turning radius. For example, Maurer et al., "Selecting Pad Heights for the First Austin Chalk Drainhole Field Test", May 30, 1985, described one possible method of predicting interference. Maurer et al. propose a method in which interference is determined based upon the equation:

$$I=h+\tfrac{1}{2}DM+L\ \mathrm{Sin}\ \theta\tfrac{1}{2}DB-DH \qquad (1)$$

where:

I=interference (in inches)
h=pad height (in inches)
DM=motor diameter (in inches)
$\theta$=bend angle
DB=bit diameter (in inches)
DH=hole diameter (in inches)
L=length from bend to bit (in inches)

Maurer then plots hole radius as a linear function of interference and uses this function to predict the turning radius of future wells.

It has been found by the inventor herein that the method proposed by Maurer et al. produces unreliable results in predicting deviated well performance. Specifically, it has been found that when actual well radius is correlated with the predicted radius using the Maurer relationship, the data do not correlate or correlate very poorly. In particular, the rate of turn was found in some cases to vary over 6° from the predicted value (or about 50%). Therefore, the interference prediction in Maurer et al. is useful only in a qualitative sense, and does not provide a quantitative prediction of turn radius. In particular, it has been found that two holes having the same turning radius might require, for example, ½" interference for a 3½' hole. Maurer et al. would predict a dramatically different turning radius.

Other art in the field includes Tiraspolsky, "Hydraulic Downhole Drilling Motors", pp. 193–194, which discloses a method of calculating an angle $\alpha$ as a function of the lengths of two sections of bent sub. Rehm, "Horizontal Drilling In Mature Oil Fields", SPE Paper No. 18709 (1988) discusses presently available curve building methods including those of Tiraspolsky (discussed above), and Taylor et al., "A Systematic Approach to Well Surveying Calculations", SPE Paper No. 3362 (1971). Talyor et al. disclose an improved method for surveying curved bore holes. A method for calculating the "dogleg" which proposes to give the same results as this appliation is disclosed by Karlsson et al., "Performance Drilling Optimization", SPE/IADC 13474 (1985).

From the above it is seen that an improved method and apparatus for determination of well turning rate is needed.

SUMMARY OF THE INVENTION

A method and apparatus for prediction of deviated well curvature, and a method and apparatus for drilling deviated wells of a desired rate of turn are disclosed. The method is effective over a wide range of hole sizes and drilling assembly parameters.

Data related to interference, bend length, and turning rate are collected for a plurality of wells. The data related to interference may include, for example bit diameter, motor diameter, pad height, bend angle, bend length, and the like. Turning rate is plotted as a linear function of a ratio of interference to bend length. Using regression techniques a best fit line may be found. Using the best fit line, the turning rate of a given drilling assembly may be accurately predicted in advance.

DETAILED DESCRIPTION OF THE INVENTION

Figure 1:
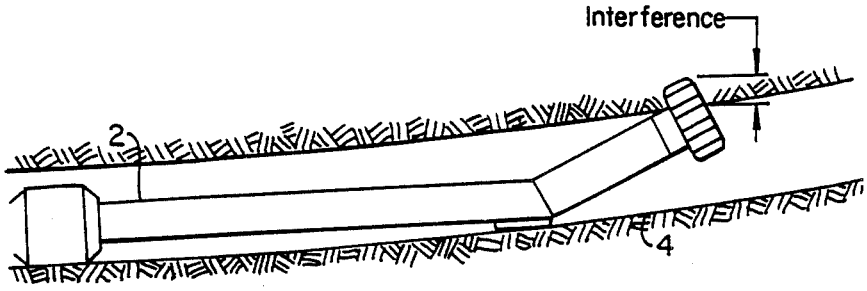
FIG. 1 illustrates the value of interference in a well drilling assembly in a wellbore.
Figure 2:
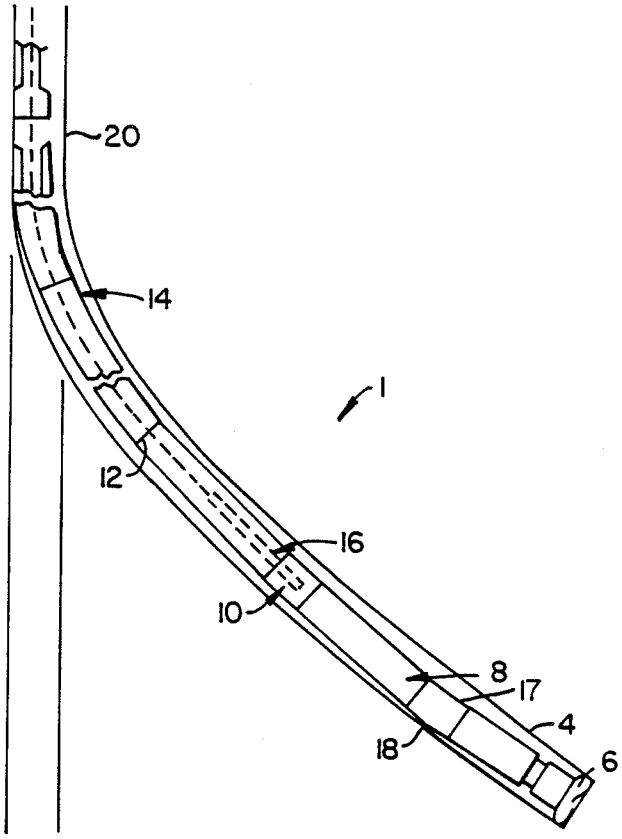
FIG. 2 illustrates a drilling assembly which may utilize the invention described herein.

FIG. 2 illustrates a drilling assembly 1 which may be used in the drilling of a deviated well in a wellbore 4. The drilling assembly includes a bit 6, a motor with a bent housing 8, a mule-shoe orienting sub with a float valve 10, non-magnetic survey collars 12, and slick drill pipe 14. A steering tool 16 may be optionally provided. Pad 18 may be utilized to provide increased deviation.

In operation, a vertical well section 20 is drilled. Vertical section 20 may, in some embodiments, be an existing well. Deviated well drilling assembly 1 is then run into the hole. The bent motor housing 8, acting in combination with pad 18 (if provided) forces the bit 6 to move sideways, much as it would in steeply-dipping beds. Survey tool 16 is used to monitor deviation of the wellbore as drilling proceeds. Mule-shoe orienting sub 10 ensures that the drilling assembly remains properly oriented.

Greater detail regarding the drilling assembly 1, as well as its operation, is provided in U.S. Pat. No. 4,789,032, which is incorporated herein by reference.

The various components of the drilling assembly are designed and manufactured before drilling commences. As a consequence, it is important for the drilling program designer to be able to accurately predict the rate at which a given drilling assembly will turn. Conversely, given a desired rate of turn, a drilling program designer must design a drilling assembly which will produce the desired rate of turn. If the drilling assembly does not produce the desired rate of turn, the financial loss can be significant due to lost rig time while making any necessary adjustments.

The rate of turn of a given drilling assembly can be accurately predicted if the bit diameter ($d^b$), the hole diameter ($d_h$), the bit length ($l_b$), the motor diamether ($d_m$), the bend length ($l_{bend}$) (i.e., the length from the bend in the bent housing to the bit), the bend angle ($\theta$), and the pad height (h) are known. As used herein, "rate of turn" is defined as the number of degrees of arc through which the well will progress in 100 feet of well length. It is to be recognized, however, that the method disclosed herein could be effectively utilized to predict any parameter indicative of the rate of turn of the wellbore including, for example, turning radius.

Figure 3:
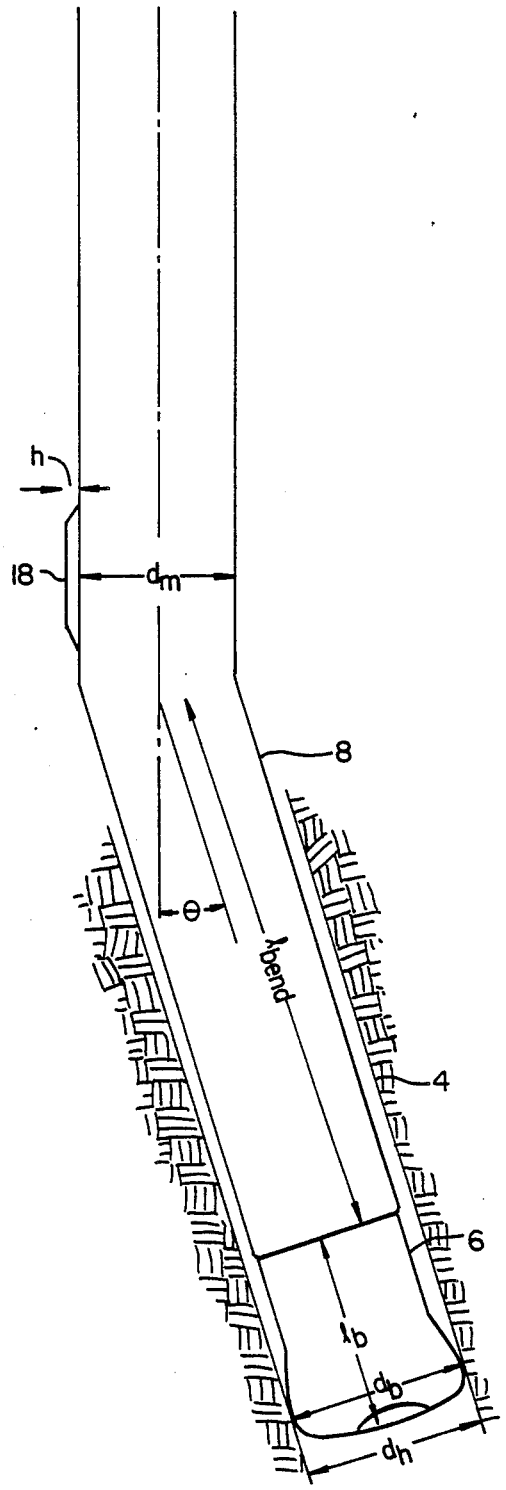
FIG. 3 illustrates the dimensions of a drilling assembly as they are utilized in the invention described herein.

The above-described parameters are further illustrated in FIG. 3. The bit diameter ($d_b$) is preferably measured at the widest portion of the bit. Bit length ($l^b$) is the distance from the shoulder of the bit thread to the end of the bit. Motor diameter ($d_m$) is the diameter of the motor near the motor assembly bend 17. It should be understood that portions of the drilling assembly other than the motor housing could serve as the bent portion, in which case the diameter of the bend portion would be utilized. Bend length ($l_{bend}$) is defined as the distance from the pipe bend to the shoulder of the thread for the bit. Bend angle is the angle (in degrees) formed between the centerline of the bent portion of the drilling assembly and the centerline of the straight portion of the drilling assembly. The pad height (h) is defined as the distance from the wall of the drill pipe or motor to the outside of the pad 18.

The rate of turn (R) produced by a drilling assembly can be accurately predicted by using an equation of the form:

$$R = k_1 \times + k_2 \tag{2}$$

where $k_1$ and $k_2$ are constants and $$x = [h + (0.5)(d_m) + ((l_{bend} + l_b)\text{-}(\sin(\theta\pi/180))) + (0.5)(d_b) - d_h]/((l_b + l_{bend})/12).$$

In general, the equation should be a linear equation where the turn radius is expressed as a linear function of the ratio of interference to total bend length. Stated in an alternative manner, turn radius is found to be a linear function of the tangent of an angle having its "opposite" side formed by an interference distance (or any parameter indicative of interference) and its "adjacent" side formed by the total bend length.

The constants $k_1$ and $k_2$ may be found by linear regression techniques of the type readily known to those of skill in the art. The parameters h, $l_{bend}$, $l_b$, $d_m$, $\theta$, $d_b$, and $d_n$ are collected for a wide variety of drilled wells. Using regression of graphical techniques it is then possible to determine the values of $k_1$ and $k_2$. In one embodiment, it has been found that the values of $k_1 = 55$ and $k_2 = 1.5$ have been found to perform especially well.

It should be further recognized that while all of the parameters related to interference have been used in the numerator of the value of "x" in the above equation, the numerator would not necessarily include all of these parameters. For example, if all of the wells to be analyzed used an assembly having an identical or nearly identical pad height, this value could be eliminated from the analysis and would generally be accounted for in the value of $k_1$.

Table 1 provides a list of cell entries used to perform the above-described calculations on a Lotus TM spreadsheet. Table 2 provides a portion of the spreadsheet produced by the cell entries of Table 1.

The effect of changing various assembly parameters on the rate of turn is demonstrated in Table 2. In general, decreasing the hole or bit diameter increases the rate of turn, as would be expected because it increases interference. It is noted that the hole/bit diameter is the same in all of the examples provided. The hole/bit diameter would not be the same when the hole is enlarged due to drilling activity such as in very soft clay or sandstone.

Increasing the bend and/or bit length decreases the turning radius, as would increasing the bend angle. Increasing pad height similarly produces higher rates of turn. Certain combinations of assembly parameters produce negative values of rate of turn. This is because the bit is pressed against the bottom of the hole.

Table 3 compares the rate of turn for actual drilling assemblies with (a) the predicted value from the method disclosed herein, and (b) the method previously disclosed by Maurer et al. The method disclosed herein consistently produces a good prediction of actual turning radius, while the method proposed by Maurer et al. is, at best, only qualitatively correct. In particular, it is noted that the method herein may be used to provide adequate predictions of turning radius regardless of the size of the hole and bottom hole assembly.

TABLE 1

| Lotus TM Spreadsheet Entries |
|---|
| D1: 'RATE OF TURN CALCULATIONS |
| D2: 'DEGREES PER 100 FEET OR 30 METERS |
| A6: HOLE |
| B6: BIT |
| C6: BIT |
| D6: MOTOR |
| E6: BEND |
| F6: BEND |
| G6: PAD |
| H6: DEGREES |
| I6: *** |
| A7: DIAMETER |
| B7: DIAMETER |
| C7: LENGTH |
| D7: DIAMETER |
| E7: LENGTH |
| F7: THETA |
| G7: HEIGHT |
| H7: TURN |
| I7: I |
| J7: IN(I)/FT |
| A8: ' (inches) |
| B8: ' (inches) |
| C8: ' (inches) |
| D8: ' (inches) |
| E8: ' (inches) |
| F8: ' (inches) |
| G8: ' (inches) |
| H8: ' (degrees) |
| 149: ' _____ |
| B9: ' _____ |
| C9: ' _____ |
| D9: ' _____ |
| E9: ' _____ |
| F9: ' _____ |
| G9: ' _____ |
| H9: ' _____ |
| I9: ' _____ |
| J9: ' _____ |
| A12: 4.5 |
| B12: 4.5 |
| C12: 6 |
| D12: 2.875 |
| E12: 33 |
| F12: 1.5 |
| G12: 0 |
| H12: (55*J12)+1.5 |
| I12: +G12+(0.5*D12)+((E12+C12)*@SIN(F12*@PI/180))+(0.5*B12)-A12 |
| J12: +I12/((C12+E12)/12) |
| A13: 3.5 |
| B13: 3.5 |
| C13: 6 |
| D13: 2.875 |
| E13: 33 |
| F13: 1.5 |
| G13: 0 |
| H13: (55*J13)+1.5 |
| I13: +G13+(0.5*D13)+((E13+C13)*@SIN(F13*@PI/180))+(0.5*B13)-A13 |
| J13: +I13/((C13+E13)/12) |
| A14: 5.5 |
| B14: 5.5 |
| C14: 6 |
| D14: 2.875 |
| E14: 33 |
| F14: 1.5 |
| G14: 0 |
| H14: (55*J14)+1.5 |
| I14: +G14+(0.5*D14)+((E14+C14)*@SIN(F14*@PI/180))+(0.5*B14)-A14 |
| J14: +I14/((C14+E14)/12) |
| A15: 4.5 |
| B15: 4.5 |
| C15: 8 |
| D15: 2.875 |
| E15: 33 |

TABLE 1-continued

| Lotus TM Spreadsheet Entries |
|---|
| F15: 1.5 |
| G15: 0 |
| H15: (55*J15)+1.5 |
| I15: +G15+(0.5*D15)+((E15+C15)*@SIN(F15*@PI/180))+(0.5*B15)-A15 |
| J15: +I15/((C15+E15)/12) |
| A16: 4.5 |
| B16: 4.5 |
| C16: 5 |
| D16: 2.875 |
| E16: 33 |
| F16: 1.5 |
| G16: 0 |
| H16: (55*J16)+1.5 |
| I16: +G16+(0.5*D16)+((E16+C16)*@SIN(F16*PI/180))+(0.5*B16)-A16 |
| J16: +I16/((C16+E16)/12) |
| A17: 4.5 |
| B17: 4.5 |
| C17: 6 |
| D17: 3 |
| E17: 33 |
| F17: 1.5 |
| G17: 0 |
| H17: (55*J17)+1.5 |
| I17: +G17+(0.5*D17)+((E17+C17)*@SIN(F17*@PI/180))+(0.5*B17)-A17 |
| J17: +I17/((C17+E17)/12) |
| A18: 4.5 |
| B18: 4.5 |
| C18: 6 |
| D18: 2.5 |
| E18: 33 |
| F18: 1.5 |
| G18: 0 |
| H18: (55*J18)+1.5 |
| I18: +G18+(0.5*D18)+((E18+C18)*@SIN(F18*@PI/180))+(0.5*B18)-A18 |
| J18: +I18/((C18+E18)/12) |
| A19: 4.5 |
| B19: 4.5 |
| C19: 6 |
| D19: 2.875 |
| E19: 30 |
| F19: 1.5 |
| G19: 0 |
| H19: (55*J19)+1.5 |
| I19: +G19+(0.5*D19)+((E19+C19)*@SIN(F19*@PI/180))+(0.5*B19)-A19 |
| J19: +I19/((C19+E19)/12) |
| A20: 4.5 |
| B20: 4.5 |
| C20: 6 |
| D20: 2.875 |
| E20: 36 |
| F20: 1.5 |
| G20: 0 |
| H20: (55*J20)+1.5 |
| I20: +G20+(0.5*D20)+((E20+C20)*@SIN(F20*@PI/180))+(0.5*B20)-A20 |
| J20: +I20/((C20+E20)/12) |
| A21: 4.5 |
| B21: 4.5 |
| C21: 6 |
| D21: 2.875 |
| E21: 33 |
| F21: 2 |
| G21: 0 |
| H21: (55*J21)+1.5 |
| I21: +G21+(0.5*D21)+((E21+C21)*@SIN(F21*@PI/180))+(0.5*B21)-A21 |
| J21: +I21/((C21+E21)/12) |
| A22: 4.5 |
| B22: 4.5 |
| C22: 6 |
| D22: 2.875 |
| E22: 33 |
| F22: 1 |
| G22: 0 |
| H22: (55*J22)+1.5 |
| I22: +G22+(0.5*D22)+((E22+C22)*@SIN(F22*@PI/180))+(0.5*B22)-A22 |
| J16: +I22/((C22+E22)/12) |
| A23: 4.5 |
| B23: 4.5 |
| C23: 6 |
| D23: 2.875 |
| E23: 33 |
| F23: 1.5 |

TABLE 1-continued

| Lotus TM Spreadsheet Entries |
|---|
| G23: 0.1 |
| H23: (55*J23)+1.5 |
| I23: +G23+(0.5*D23)+((E23+C23)*@SIN(F23*@PI/180))+(0.5*B23)-A23 |
| J23: +I23/((C23+E23)/12) |
| A24: 4.5 |
| B24: 4.5 |
| C24: 6 |
| D24: 2.875 |
| E24: 33 |
| F24: 1.5 |
| G24: 0.2 |
| H24: (55*J24)+1.5 |
| I24: +G24+(0.5*D24)+((E24+C24)*@SIN(F24*@PI/180))+(0.5*B24)-A24 |
| J24: +I24/((C24+E24)/12) |
| A28: ' ® Ccopyright, 1988 |
| A29: 'BecField Horizontal Drilling Company |

TABLE 2

| Rate of Turn Calculations Degrees Per 100 Feet of 30 Meters | | | | | | | |
|---|---|---|---|---|---|---|---|
| Hole Diameter (inches) | Bit Diameter (inches) | Bit Length (inches) | Motor Diameter (inches) | Bend Length (inches) | Bend Theta (inches) | Pad Height (inches) | Degrees Turn (degrees) |
| 4.5 | 4.5 | 6 | 2.875 | 33 | 1.5 | 0 | 5.026785 |
| 3.5 | 3.5 | 6 | 2.875 | 33 | 1.5 | 0 | 13.48832 |
| 5.5 | 5.5 | 6 | 2.875 | 33 | 1.5 | 0 | −3.43475 |
| 4.5 | 4.5 | 8 | 2.875 | 33 | 1.5 | 0 | 5.697517 |
| 4.5 | 4.5 | 5 | 2.875 | 33 | 1.5 | 0 | 4.664943 |
| 4.5 | 4.5 | 6 | 3.000 | 33 | 1.5 | 0 | 6.084478 |
| 4.5 | 4.5 | 6 | 2.500 | 33 | 1.5 | 0 | 1.853708 |
| 4.5 | 4.5 | 6 | 2.875 | 30 | 1.5 | 0 | 3.880952 |
| 4.5 | 4.5 | 6 | 2.875 | 36 | 1.5 | 0 | 6.008928 |
| 4.5 | 4.5 | 6 | 2.875 | 33 | 2.0 | 0 | 10.78366 |
| 4.5 | 4.5 | 6 | 2.875 | 33 | 1.0 | 0 | −0.73141 |
| 4.5 | 4.5 | 6 | 2.875 | 33 | 1.5 | 0.1 | 6.719093 |
| 4.5 | 4.5 | 6 | 2.875 | 33 | 1.5 | 0.2 | 8.411401 |

TABLE 3

| Well | Assembly No. | Actual Turning Radius Degrees/100' | Predicted Turning Radius Degrees/100' | Maurer et al. Calculation Inches of Interference | Maurer et al. Hole Radius (feet) |
|---|---|---|---|---|---|
| Luther | 1 | 17 | 17 | 1.095 | ∞0 |
| Luther | 2 | 0.25 | 0 | −0.126 | Indeterminant |
| Armadillo | 1 | 19 | 20 | 1.345 | <0 |
| Armadillo | 3 | 1 | 0 | −0.126 | Indeterminant |
| Armadillo | 4 | 17 | 20 | 1.345 | <0 |
| Hoffman | 1 | 19 | 10 | 1.345 | <0 |
| Proske | 2 | 18 | 17 | 1.095 | <0 |
| Proske | 4 | 15 | 15 | 0.981 | 130 |

The above-described method makes it possible to readily predict the turning radius for any given drilling assembly configuration. In certain wells, various parameters may be fixed. For example, outside constraints, such as equipment availability, may dictate that a particular bit diameter, bit length, and bend angle be utilized. Therefore, these factors are fixed and the bend length and pad height may be adjusted until the desired turning radius is predicted. The well is then drilled using the methods described in, for example, U.S. Pat. No. 4,789,032, which is incorporated herein by reference.

It is to be understood that the above description is intended to be illusrative and not restrictive. The scope of the invention should, therefore, be determined not with reference to the above description but, instead, should be determined with reference to the appended claims, along with their full scope of equivalents.

What is claimed is:

1. A method of drilling a deviated well having a desired rate of turn, said deviated well to be drilled with a drilling assembly having a bend therein, comprising the steps of:

(a) collecting data indicative of interference, drilling assembly bend length, and turning rate from a plurality of drilled wells;

(b) providing a relation between said turning rate and a parameter related to the said interference divided by said drilling assembly bend length;

(c) inputting at least one set of data indicative of interference and drilling assembly bend length for said deviated well to be drilled;

(d) based on said relation, indicating a predicted value of turning radius for said well to be drilled;

(e) based on said predicted value of turning radius for said well to be drilled, selecting a drilling assembly which will provide substantially said desired rate of turn; and (f) drilling said well to be drilled using said selected drilling assembly.

2. The method as recited in claim 1, wherein said data indicative of interference comprises bend length and bend angle.

3. The method as recited in claim 1, wherein said data indicative of interference comprises bend length, bend angle, and pad height.

4. The method as recited in claim 2, wherein said data indicative of interference comprises a bit diameter, and a well diameter.

5. The method as recited in claim 1, wherein said relation is a linear relation.

6. A method of drilling a deviated well having a desired turning radius comprising the steps of:

(a) providing data indicative of interference, drilling assembly bend length, and turning rate from a plurality of drilled wells;

(b) providing a linear relation between said turning rate and a ration of said interference to said bend length;

(c) based on said linear relation, providing a drilling assembly that will drill a well with substantially said desired turning radius; and (d) drilling said well with said drilling assembly.

7. A method of drilling a hydrocarbon well into a petroleum-bearing formation with a bent drilling assembly, said well to deviate substantially from vertical, comprising the steps of:

(a) storing data from a plurality of drilled wells in an appropriately programmed digital computer, said data comprising pad height (h), motor diameter ($d_m$), bend angle ($\theta$), bit diameter ($d_b$), bit length ($l_b$), hole diameter ($d_h$), distance from bend to bit ($l_{bend}$), and rate of turn (R);

(b) based on said data from a plurality of drilled wells, determining regression coefficients $k_1$ and $k_2$ in a linear relation of the form:

$$R = k_1 + k_2$$

where:

$$x = [h + (0.5)(d_m) + ((l_{bend} + l_b) \cdot (\sin(\theta\pi/180))) + (0.5)(d_b) - d_h]/((l_b + l_{bend})/12);$$

(c) using said regression coefficients, estimating a turning radius of a plurality of bent drilling assemblies;

(d) selecting one of said bent drilling assemblies, said one of said bent drilling assemblies predicted to have substantially a desired turning radius; and (e) drilling said well with said selected one of said bent drilling assemblies.

* * * * *